US005463557A

United States Patent [19]

Nakano et al.

[11] Patent Number: 5,463,557

[45] Date of Patent: Oct. 31, 1995

[54] ROVING MACHINE

[75] Inventors: Tsutomu Nakano; Katsumi Nakane, both of Kariya, Japan

[73] Assignee: Kabushiki Kaisha Toyoda Jidoshokki Seisakusho, Kariya, Japan

[21] Appl. No.: 59,079

[22] Filed: May 5, 1993

[30] Foreign Application Priority Data

May 15, 1992 [JP] Japan ..... 4-123936
Sep. 17, 1992 [JP] Japan ..... 4-248322

[51] Int. Cl.[6] ..... D01H 1/26

[52] U.S. Cl. ..... 364/470; 57/96; 57/264

[58] Field of Search ..... 364/470, 469; 57/96, 93, 94, 95, 97, 99, 98, 100, 264; 28/101

[56] References Cited

U.S. PATENT DOCUMENTS

| | | | |
|---|---|---|---|
| 4,134,253 | 1/1979 | Handa et al. | 57/96 |
| 4,375,744 | 3/1983 | Briner et al. | 57/96 |
| 4,551,969 | 11/1985 | Kogiso et al. | 57/264 |
| 4,569,192 | 2/1986 | Yamada et al. | 57/317 |
| 4,698,957 | 10/1987 | Satzger et al. | 57/96 |
| 4,890,452 | 1/1990 | Nishikawa et al. | 57/276 |
| 5,038,438 | 8/1991 | Gunter | 19/65 |

FOREIGN PATENT DOCUMENTS

| | | |
|---|---|---|
| 0406176 | 1/1991 | European Pat. Off. . |
| 0452835 | 4/1991 | European Pat. Off. . |
| 63-264923 | 11/1988 | Japan . |

OTHER PUBLICATIONS

English language Abstract of Japanese Unexamined Patent Publication No. 63–264,923. Nov. 1, 1988.

*Primary Examiner*—Roy N. Envall, Jr.
*Assistant Examiner*—Brian C. Oakes
*Attorney, Agent, or Firm*—Brooks Haidt Haffner & Delahunty

[57] ABSTRACT

A data base used for determining the amount of decrease in the bobbin rotational speed that corresponds to an increase in the number of roving layers, along with silver weight, fiber kind, the number of revolutions of a flyer and the number of laps over presser, etc. as variables, is stored in a program memory. Based on roving conditions entered through an input unit and the data base stored in the program memory, a CPU calculates the amount of decrease of the bobbin rotational speed that corresponds to the increase in the number of sliver layers. With a control signal output from the CPU in response to the increase in the number of sliver layers, a wind-up motor is controlled to slow down so that the bobbin rotational speed is gradually reduced by a predetermined amount. The bobbin rotational speed is also controlled depending on the sliver position between a front roller and a flyer top.

11 Claims, 6 Drawing Sheets

○ m : COTTON(CARDED)
n : 3 TIMES
t : A TYPE
$N_F$: 1000~1200rpm

□ m : COTTON(COMBED)
n : 4 TIMES
t : B TYPE
$N_F$: 800~1000rpm

X m : SYNTHETIC FIBER
n : 4 TIMES
t B TYPE
$N_F$: 1000~1200rpm

○ m : COTTON(CARDED)
n : 3 TIMES
t : A TYPE
$N_F$ : 1000~1200rpm

□ m : COTTON(COMBED)
n : 4 TIMES
t : B TYPE
$N_F$ : 800~1000rpm

× m : SYNTHETIC FIBER
n : 4 TIMES
t : B TYPE
$N_F$ : 1000~1200rpm

ROVING MACHINE

BACKGROUND OF THE INVENTION

1. Field of the Invention

The present invention relates to a roving machine including a wind-up speed changing apparatus, which reduces a bobbin rotational speed in response to the increased number of roving layers wound onto the bobbin.

2. Description of the Prior Art

In roving machines of bobbin loading type, a sliver let out of a front roller at a certain speed is wound up over a bobbin while twisting the sliver due to a difference in rotational speed between a flyer rotating at a predetermined speed and the bobbin rotating at a higher speed. The bobbin is supported by a bobbin rail and vertically moved therewith. Each time the direction of up/down movement of the bobbin rail is changed, the distance through which the bobbin rail moves is shortened to wind up the sliver so that the wound thread (roving) roll has a conical shape at both ends.

To satisfactorily wind up a sliver, the winding is required to be performed under such a condition that there is a proper slack in the sliver between the front roller and a flyer top. If a tension of the sliver is fluctuated during the winding, the weight of the wound roving per unit length is also fluctuated to make the roving uneven. Also, to hold the sliver tension constant for proper winding, the winding must be performed so that the let-out amount and the wind-up amount of the sliver becomes almost equal to each other during the winding; otherwise unevenness and disconnection of the roving may occur due to fluctuations in the sliver tension.

When the bobbin rotational speed is kept constant from start to end of the winding, the wind-up speed increases with an increase in the number of wound roving layers (i.e., the diameter of the wound roving roll). Therefore, a speed changing apparatus using a pair of cone drum and belt shifter has been conventionally employed to control the bobbin rotational speed to be gradually lowered as the number of roving layers wound around the bobbin increases.

However, because the rate of increase of the roving roll diameter with respect to the number of roving layers wound around the bobbin is changed depending on the roving conditions, it has been required to change the configuration of the cone drum (or replace the cone drum) depending on the roving conditions, or modify the amount of movement of the belt shifter by using an adjustable auxiliary cam depending on the roving conditions (see Japanese Patent Publication No. 52-48652). Thus, a troublesome replacement or adjustment operation has been required for each change of the roving conditions.

To solve those disadvantages, there has been proposed and practiced an apparatus in which a sensor is provided between the front roller and the flyer top for detecting the position of the sliver leading from the front roller to the flyer top, and a belt trained over a cone drum is shifted to adjust the bobbin rotational speed so that the position of the sliver under roving is kept at a preset target position, thereby controlling the winding tension (see, for example, Japanese Patent Laid-Open No. 62-85304).

There has also been proposed an apparatus in which a gear system for driving a long rack in cooperation with the belt shifter is driven by a motor, and driving of the motor is controlled so that an amount of movement of the belt shifter becomes a value corresponding to the number of wound roving layers and input in a microcomputer beforehand (see Japanese Patent Laid-Open No. 62-117829).

Further, there has recently existed a keen demand for multikind and small-quantity production. To accommodate frequent changes of the roving conditions encountered in such production, a roving machine has been proposed in which a sliver drive system and a winding drive system are separately operated by respective variable speed motors, and driving of these variable speed motors is controlled based on data input to a storage beforehand depending on the roving conditions (see, for example, Japanese Patent Laid-Open No. 63-264923).

In the apparatus disclosed in Japanese Patent Publication No. 52-48652 that the amount of movement of the belt shifter is adjustable, while replacing the cone drum is not required upon each change of the roving conditions, it is necessary to set a proper amount of movement of the belt shifter upon each change of the roving conditions in order that the amount of decrease in the bobbin rotational speed becomes an appropriate value corresponding to the increase in the number of wound roving layers.

Also, in the apparatus disclosed in Japanese Patent Laid-Open No. 62-17829 in which a sliver drive system and a winding drive system are separately operated by respective variable speed motors, it is necessary, upon each change of the roving conditions, to set a proper amount of decrease in the bobbin rotational speed corresponding to an increase in the number of wound roving layers.

For setting a proper amount of movement of the belt shifter for a proper amount of decrease in the bobbin rotational speed, if there are data obtained in the past from a sliver carried out under the same conditions, those data can be used. If not, the setting must be made through estimation only based on past experiences and intuition of an operator. However, since the resulting estimated value is not always a proper value, trial roving is needed.

Depending on the roving conditions, the trial roving must be often repeated several times until the estimated value approaches the proper value. This gives rise to problems in that raw materials and labor necessary for the trial roving are wasted and the operating ratio of the roving machine is lowered. These problems become severer with frequent changes of the roving conditions to be adapted for multikind and small-quantity production.

SUMMARY OF THE INVENTION

A main object of the present invention is, therefore, to provide a roving machine in which, by entering roving conditions via an operator, the amount of decrease in a bobbin rotational speed corresponding to an increase in the number of wound roving layers is automatically calculated in accordance with the roving conditions so that the bobbin rotational speed is properly changed depending on the roving conditions.

Another object of the present invention is to provide a roving machine in which, when changing the bobbin rotational speed as mentioned above, a sliver between a front roller and a flyer top is objectively set by the operator to a position corresponding to a proper sliver tension so that the sliver can be wound up under a certain tension.

To achieve the above objects, according to the present invention, a roving machine including a wind-up speed changing apparatus which reduces the bobbin rotational speed in response to the increased number of roving layers wound around the bobbin, comprises storage means for storing a data base used to determine the bobbin rotational speed corresponding to an increase in the number of wound roving layers with at least sliver weight, fiber kind, the number of revolutions of a flyer (speed of rotation) and the number of laps over a presser as variables, input means through which roving conditions such as sliver weight, fiber kind, the number of revolutions of the flyer and the number of laps over the presser are entered, and control means for calculating, based on the roving conditions entered through the input means and the data base stored in the storage means, the amount of decrease of the bobbin rotational speed corresponding to the increase in the number of wound roving layers under those roving conditions, and outputting a control signal for achieving the decreased bobbin rotational speed to the wind-up speed changing apparatus.

The roving machine may further comprise supplementation means for, after roving operation in a proper winding state, supplementing the relationship between the roving conditions and the amount of decrease in the bobbin rotational speed corresponding to the increase in the number of wound roving layers in that roving operation, as data for updating the data base.

With the present invention, in response to an increase in the number of wound roving layers, the bobbin rotational speed is changed based on a preset bobbin rotational speed changing pattern to be controlled so that the sliver tension is kept in a proper state. When the roving conditions such as sliver weight, fiber kind, the number of revolutions of the flyer and the number of laps over the presser are entered through the input means, the control means calculates, based on the entered roving conditions and the data base stored in the storage means, the amount of decrease of the bobbin rotational speed corresponding to the increase in the number of wound roving layers under those roving conditions. Then, the control means outputs the control signal to the wind-up speed changing apparatus for rotating the bobbin at the decreased bobbin rotational speed. Thus, the wind-up speed changing apparatus is operated in accordance with the control signal so that the bobbin rotational speed is properly changed for each increase in the number of wound roving layers.

In the present roving machine, by entering the roving conditions via an operator, the amount of decrease of the bobbin rotational speed corresponding to the increase in the number of wound roving layers is automatically calculated in accordance with the entered roving conditions.

Therefore, experiences and intuition which have been required of the operator in the past can be needless. It is also possible to diminish waste of labor, time, raw material, etc. consumed by the trial roving made for setting the proper amount of decrease in the bobbin rotational speed corresponding to the increase in the number of wound roving layers in accordance with the roving conditions.

Further, with the roving machine which includes the supplementation means, in addition to the above advantage, the bobbin rotational speed data in a proper winding state obtained during the previous winding operation are effectively utilized for the next winding operation to improve reliability of the data base.

Moreover, according to the present invention, the roving machine further comprises a contactless position sensor for continuously detecting the sliver position between the front roller and the flyer top, and the wind-up speed changing apparatus controls the bobbin rotational speed based on an output signal of the position sensor. To this end, the storage means also stores a data base or a calculation formula used for determining a shift amount of the sliver leading from the front roller to the flyer top from a reference position of the position sensor in a proper tension state with at least roving weight as a variable, and the control means calculates, based on the roving conditions entered through the input means and the data base or the calculation formula stored in the storage means to determine the sliver shift amount, the shift amount of the sliver from the reference position in the proper tension state under those roving conditions, and changes the bobbin rotational speed using the calculated shift amount as a control target value during roving operation so that an actual shift amount of the sliver during the roving operation indicated by the output signal of the position sensor becomes equal to the control target value.

The reference position is preferably set to a position where a straight line connecting the front roller and the flyer top crosses the detectable range of the position sensor.

Thus, according to the present invention, since the reference position for adjusting the amount of slack of the sliver to the set value in the proper sliver tension state can be objectively set by the operator rather than subjectively, and the proper slack amount from the reference position can be automatically calculated as a fixed value, variations in proper tension between plural sensors provided on the same unit machine or between plural different unit machines constituting the entire roving machine are avoided. Accordingly, the sliver tension during the roving is surely adjusted to a predetermined value, making it possible to eliminate variations in quality of roving rolls obtained from the roving machine between its different unit machines, and hence to produce high quality roving.

DETAILED DESCRIPTION OF THE EMBODIMENTS

Hereinafter, preferred embodiments of the present invention will be described with reference to the drawings.

Drive systems of a roving machine are basically the same as those disclosed in Japanese Patent Laid-Open No.

63-264923 previously proposed by the applicant except for an up/down movement switching mechanism for the bobbin rail.

Figure 1:
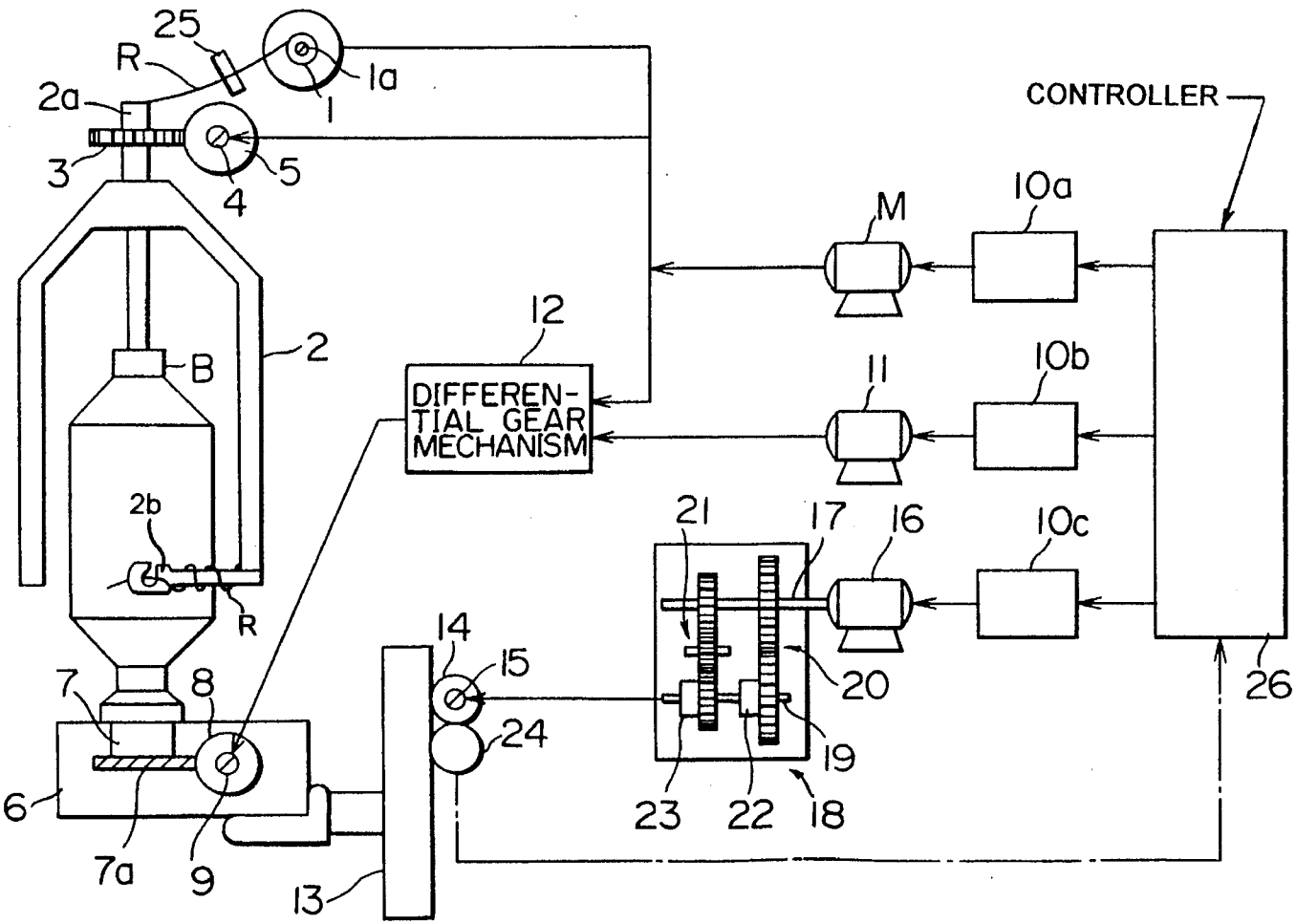
FIG. 1 is a schematic view of drive systems in a roving machine according to the present invention.

In FIG. 1, a front roller 1 is rotatively driven via a gear train (not shown) disposed between one end of its rotary shaft la and a driving shaft (not shown) which is in turn rotatively driven by a main motor M. A driven gear 3 is fixedly secured to a top portion of a flyer 2 to be rotatable therewith, and is rotatively driven via a driver gear 5 fitted to a rotary shaft 4 upon rotation of the rotary shaft 4 to which rotation of the driving shaft is transmitted via a belt transmission mechanism (not shown).

On the other hand, a driven gear 7*a* is fixed to each of spindles 7 installed in a line over a bobbin rail 6. A driver gear 8 in mesh with the driven gear 7*a* is fixedly secured to a rotary shaft 9 to which torque of the driving shaft and torque of a wind-up motor 11, driven via an inverter 10*b* in a speed variable manner, are transmitted after being combined by a differential gear mechanism 12.

The wind-up motor 11, the differential gear mechanism 12, etc. jointly constitute a wind-up speed changing apparatus for decreasing the bobbin rotational speed corresponding to an increase in the number of wound roving layers.

A lifter rack 13 is fixed to the bobbin rail 6. A gear 14 in mesh with the lifter rack 13 is fitted to a rotary shaft 15 to which rotation of a drive shaft 17 driven by an up/down motor 16 which is in turn driven via an inverter 10*c* in a speed variable manner, is transmitted via an up/down movement switching mechanism 18 and a gear train (not shown). The switching mechanism 18 comprises an intermediate shaft 19, a pair of gear trains 20, 21 disposed between the intermediate shaft 19 and the drive shaft 17, and solenoid clutches 22, 23 for transmitting rotation of the gear trains 20, 21 to the intermediate shaft 19.

Depending on energization and de-energization of the solenoid clutches 22, 23, the direction of rotation of the rotary shaft 15, i.e., the direction of up/down movement of the bobbin rail 6, is changed. Connected to one end of the rotary shaft 15 is a rotary encoder 24 as a sensor for sensing the direction of up/down movement of the bobbin rail 6.

Between the front roller 1 and a flyer top 2a, there is provided a contactless position sensor 25 for continuously detecting the actual position of a sliver R leading from the front roller 1 to the flyer top 2*a*. The sensor 25 comprises, as with that disclosed in Japanese Patent Laid-Open No. 62-85036, a light emitting portion constituted by a line of numerous infrared emitting diodes arranged in a zigzag pattern, and a light receiving portion constituted by a line of numerous infrared receiving elements arranged to face the diodes one by one. The sliver R is positioned between the light emitting portion and the light receiving portion. Each infrared receiving element outputs an electric signal upon receiving light emitted from the corresponding infrared emitting element. In other words, upon the sliver R interrupting the light from the light emitting portion, the infrared receiving element corresponding to the position of the roving R fails to receive the light. The position of the sliver R can be determined by detecting that infrared receiving element. One or a plurality of sensors 25 may be provided on each of the unit machines constituting the entire roving machine.

Figure 2:
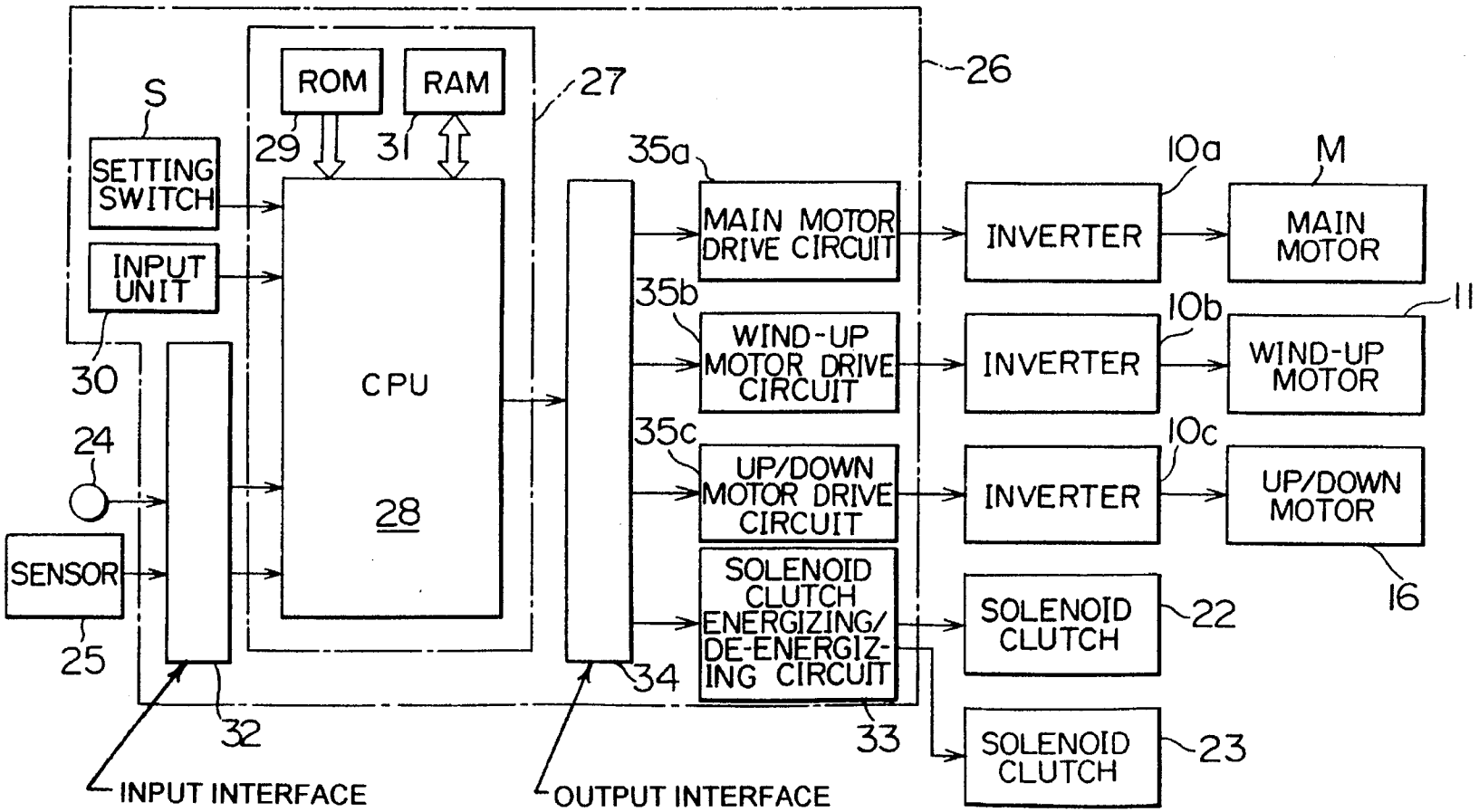
FIG. 2 is a block diagram showing the electrical configuration of the controller for use in the drive systems of FIG. 1.

A description will now be made of a control circuit for driving and controlling the drive systems with reference to FIG. 2. A microcomputer 27 constituting a controller 26 includes a central processing unit (hereinafter referred to as a CPU) 28 as control means, a program memory 29 comprising a read only memory (ROM) in which control programs are stored, and a working memory 31 comprising a read/rewritable memory (RAM) in which input data entered through an input unit 30, results of arithmetic operations executed in the CPU 28, etc. are stored temporarily. The CPU 28 is operated based on the program data stored in the program memory 29.

The input unit 30 as input means through which roving conditions such as sliver weight, fiber kind, the number of revolutions of the flyer 2 and the number of laps over a presser 26 are entered is integrally built in the form of a keyboard in the controller 26. An output signal of the rotary encoder 24 is applied to the CPU 28 via an input interface 32. A setting switch S is connected to the controller 26 so that, when the setting switch S is turned on, the sliver position detected by the sensor 25 at that time is stored in the working memory 3. The solenoid switches 22, 23 are controlled in their energization and de-energization via a solenoid clutch energizing/de-energizing circuit 33 in accordance with a signal from the CPU 28, thereby switching over up/down movement of the bobbin rail 6. Further, the CPU 28 drives and controls the main motor M, the wind-up motor 11 and the up/down motor 16 via an output interface 34 and, respectively, motor drive circuits 35*a*, 35*b*, 35*c* and inverters 10*a*, 10*b*, 10*c*.

The program memory 29 stores a data base used for determining the amount of decrease of the bobbin rotational speed corresponding to an increase in the number of wound roving layers with at least sliver weight (g; grain), fiber kind (m), the number of revolutions of the flyer 2 (NF), the number of laps over a presser 26 (n) and the flyer type (t) as variables. The fiber kind implies a difference in the sliver such as carded cotton, combed cotton and synthetic fiber. The flyer type includes a difference in a presser's pressure.

The data base is prepared as follows. Data on operating conditions accumulated as basic materials in the past are pigeonholed and, for each of classified sample groups, a relation formula between an amount of decrease Δ of the bobbin rotational speed corresponding to an increase in the number of wound roving layers and used sliver weight (g) is derived by using, for example, a statistical processing technique. The resulting formula $\Delta = F(g)$ is stored as the data base in the program memory 29.

Figure 3:
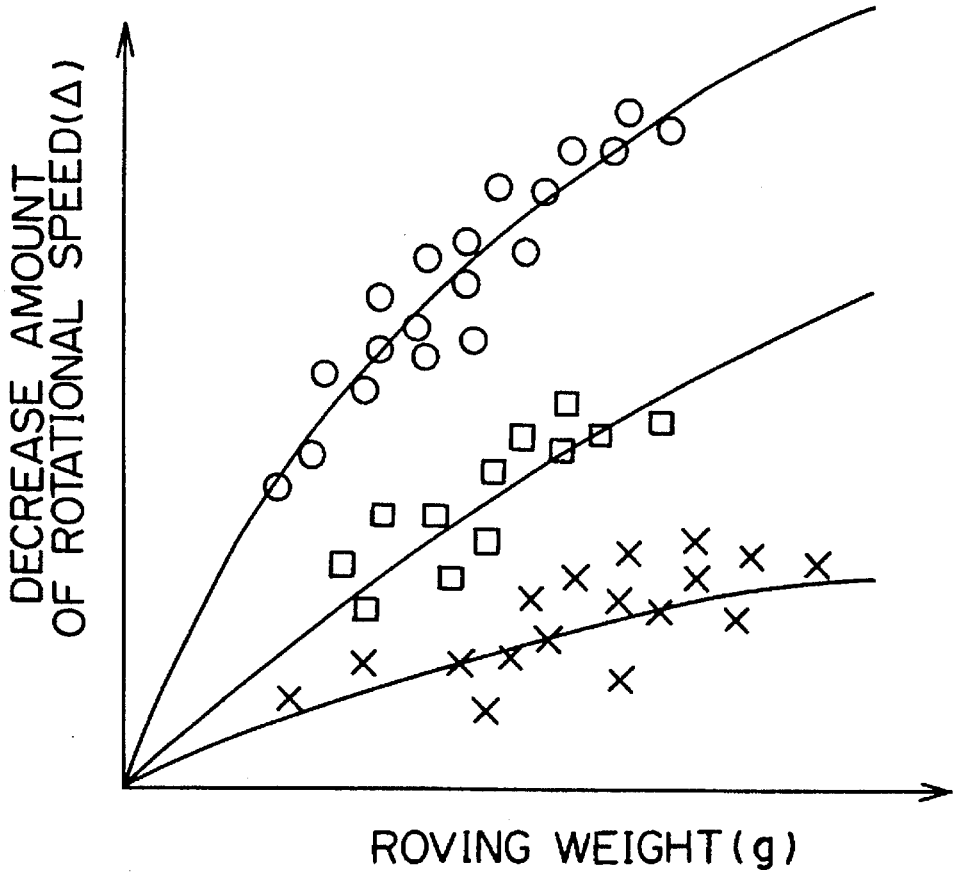
FIG. 3 is a graph showing the relationships between the amount of decrease of the bobbin rotational speed corresponding to an increase in the number of wound roving layers and variables such as sliver weight, fiber kind, the number of revolutions of a flyer and the number of laps over a presser in a first embodiment.

As to data obtained on condition that the fiber kind (m), the number of revolutions of the flyer (NF), the number of laps over the presser (n) and the flyer type (t) are the same, by way of example, the amount of decrease Δ of the bobbin rotational speed corresponding to the increase in the number of wound roving layers and the used sliver weight (g) are plotted as variables on the coordinates and a relation formula therebetween is derived, as shown in FIG. 3. While the fiber kind (m), the number of revolutions of the flyer (NF), the number of laps over the presser (n) and the flyer type (t) are discrete data, the used sliver weight (g) is variously changed depending on the roving conditions. Therefore, if there are only data indicated by ○, □, X and other marks as shown in FIG. 3, it is required to additionally set the amount of decrease Δ of the bobbin rotational speed corresponding to the increase in the number of wound roving layers in the case of roving a sliver which has a used sliver weight (g) corresponding to none of the marks. In the present invention, however, the relationship between the amount of decrease Δ of the bobbin rotational speed corresponding to the increase in the number of wound roving layers is stored as the data base in the form of a continuous relation derived from those data. FIG. 3 illustrates, by way of example, three sample groups of those data respectively indicated by ○, □ and X marks; i.e., 1) m: cotton (carded), n: 3 times, t: A type, NF: 1000–1200 rpm, 2) m: cotton (combed), n: 4 times, t: B type, NF: 800–1000 rpm, and 3) m: synthetic fiber, n: 4 times, t: B type, NF: 1000–1200 rpm.

Operation of the roving machine constructed as explained above will be described below. Prior to operating the machine (unit machine or entire machine), the roving conditions such as sliver weight (g; grain), fiber kind (m), the number of revolutions of the flyer (NF), the number of laps over the presser (n) and the flyer type (t) are entered through the input unit 30. When the roving conditions are entered, the CPU 28 sets, based on the data base stored in the program memory 29, the amount of decrease Δ of the bobbin rotational speed corresponding to the increase in the number of wound roving layers under those roving conditions.

After that, operation of the machine is started and the main motor M rotatively drives the front roller 1 and the flyer 2. At the same time as start-up of the machine, the wind-up motor 11 and the up/down motor 16 are also driven. Thus, the torque of the main motor M and the torque of the wind-up motor 11, both input to the differential gear mechanism 12, are combined by the differential gear mechanism 12, and the rotary shaft 9 is driven by the combined torque for rotating the spindle 7. With rotation of the spindle 7, the sliver R having been elongated by a draft device is twisted by the flyer 2 and wound up in the form of a multi-layered roll around a bobbin B rotating at a speed greater than the flyer 2. Also, driving of the up/down motor 16 causes, via the switching mechanism 18, the rotary shaft 15, etc., the bobbin rail 6 to be moved up and down together with the lifter rack 13. The wind-up speed and the up/down speed of the bobbin rail 6 are varied by changing respective rotational speeds of the wind-up motor 11 and the up/down motor 16.

The CPU 28 receives the output signal of the rotary encoder 24, calculates the position of the bobbin rail 6, and outputs an energization/de-energization switching signal to the solenoid clutches 22, 23 for providing the thread roll shape (i.e., a shoulder angle of the thread roll) depending on the roving conditions. With the solenoid clutches 22, 23 energized and de-energized, the bobbin rail 6 is moved up and down within a predetermined range.

Also, the CPU 28 detects the timing of up/down switching of the bobbin rail 6 based on the output signal of the rotary encoder and controls driving of the wind-up motor 11 via the inverter **10*b* so that the bobbin rotational speed is reduced by the aforesaid amount of decrease Δ for each increase in the number of wound roving layers. Then, the rotational speed of the bobbin B is reduced by the proper amount of decrease Δ for each increase in the number of wound roving layers. Simultaneously, the speed of the up/down motor 16 is also controlled to be reduced corresponding to speed-down of the wind-up motor 11, whereby the speed of movement of the bobbin rail 6** is reduced in synchronism with the wind-up speed.

Another embodiment will be next described. While the data base used for setting the amount of decrease the bobbin rotational speed corresponding to the increase in the number of wound roving layers is limited to one stored beforehand in the program memory 29 and hence fixed in the above embodiment, the data base can be modified or updated in this embodiment.

More specifically, the program memory 29 in this embodiment stores not only a program for deriving the relationship between the amount of decrease Δ and the sliver weight (g; grain) as the data base, but also data representing the relationship of sliver weight (g; grain), fiber kind (m), the number of revolutions of the flyer (NF), the number of laps over the presser (n) and the flyer type (t) versus the amount of decrease of the bobbin rotational speed corresponding to the increase in the number of wound roving layers. Further, data representing the relationship between new roving conditions and the amount of decrease Δ can be stored in the working memory 31. In this embodiment, the working memory 31 serves as supplementation means for supplementing the relationship between new roving conditions and the amount of decrease Δ as data for updating the data base. The CPU 28 derives the data base from the program and the data stored in the program memory 29, as well as the update data stored in the working memory 31 if they are present, followed by calculating, based on that data base, the decrease amount of decrease Δ of the bobbin rotational speed corresponding to the increase in the number of wound thread layers in accordance with the roving conditions.

When the roving operation is carried out using the amount of decrease Δ calculated from the current data base, the operator may adjust the tension for the reason that the amount of decrease is insufficient for the actual roving operation. In this case, the amount of decrease Δ in the actual proper roving operation after the tension adjustment and the roving conditions at that time are stored in the working memory 31 as data for deriving a new data base. Then, the CPU 28 derives the new data base from the data stored in the program memory 29 and the new data stored in the working memory 31, and calculates, based on the new data base, the amount of decrease Δ of the bobbin rotational speed corresponding to the increase in the number of wound roving layers in accordance with the roving conditions.

Figure 4:
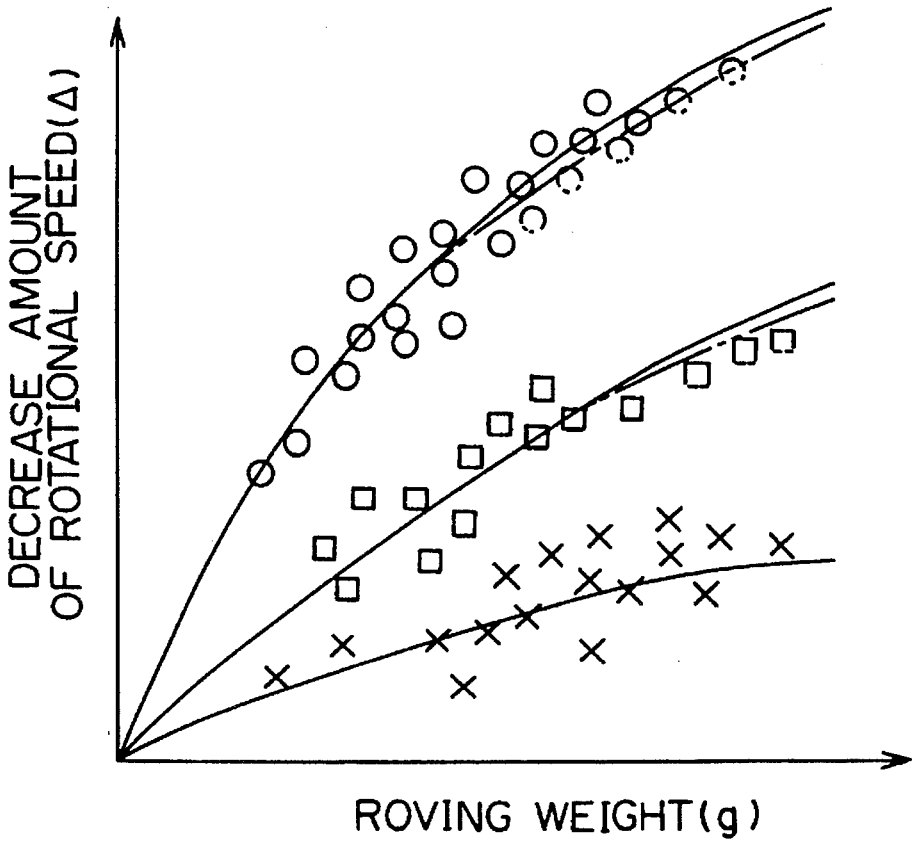
FIG. 4 is a graph showing the relationships between the amount of decrease in the bobbin rotational speed corresponding to an increase in the number of wound roving layers and variables such as sliver weight, fiber kind, the number of revolutions of the flyer and the number of laps over the presser in a second embodiment.

Stated otherwise, in this embodiment, new data are successively supplemented, as the data for determining a curve as the data base, in addition to the data stored beforehand in the program memory 29. Accordingly, as shown in FIG. 4, at the time of determining a curve representing the relation formula as the data base, the new data indicated by chain lines are added besides the original data indicated by solid lines and, as a result, reliability of the curve as the data base is improved.

It should be understood that the present invention is not limited to the above embodiments. For example, the data base used for calculating the amount of decrease Δ of the bobbin rotational speed corresponding to the increase in the number of wound roving layers may be a function expressing the amount of decrease Δ by two variables, i.e., the sliver weight (g; grain) and the number of revolutions of the flyer (NF). Also, the wind-up speed changing apparatus may be constituted by using a cone drum and driving a gear train by a motor which gear train in turn drives a long rack in cooperation with a belt shifter, as with one disclosed in Japanese Patent Laid-Open No. 62-117829, and a feed amount of the long rack may be reduced in place of the amount of decrease Δ of the bobbin rotational speed corresponding to the increase in the number of wound roving layers. Further, the drive systems of the roving machine may be constituted so as to drive all the drive systems independently of one another by respective motors, without providing the differential gear mechanism 12.

In addition, the program memory 29 stores, in addition to the above-explained data base used for determining the amount of decrease Δ of the bobbin rotational speed corresponding to the increase in the number of wound roving layers with the sliver weight (g; grain), the fiber kind (m), the number of revolutions of the flyer (NF), the number of laps over the presser (n) and the flyer type (t) as variables, a data base used for determining a shift amount of the sliver R leading from the front roller 1 to the flyer top 2*a* from a reference position in the detectable range of the position sensor 25 in a proper tension state with roving weight (grain) as a variable.

Figure 6:
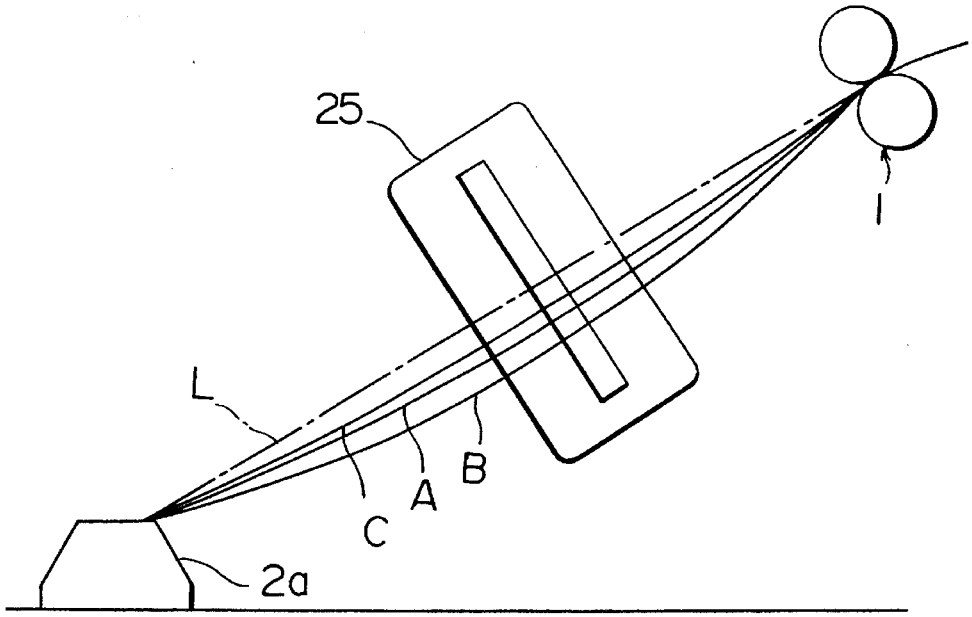
FIG. 6 is a side view showing various states of a sliver portion between the front roller and the flyer top.
Figure 7:
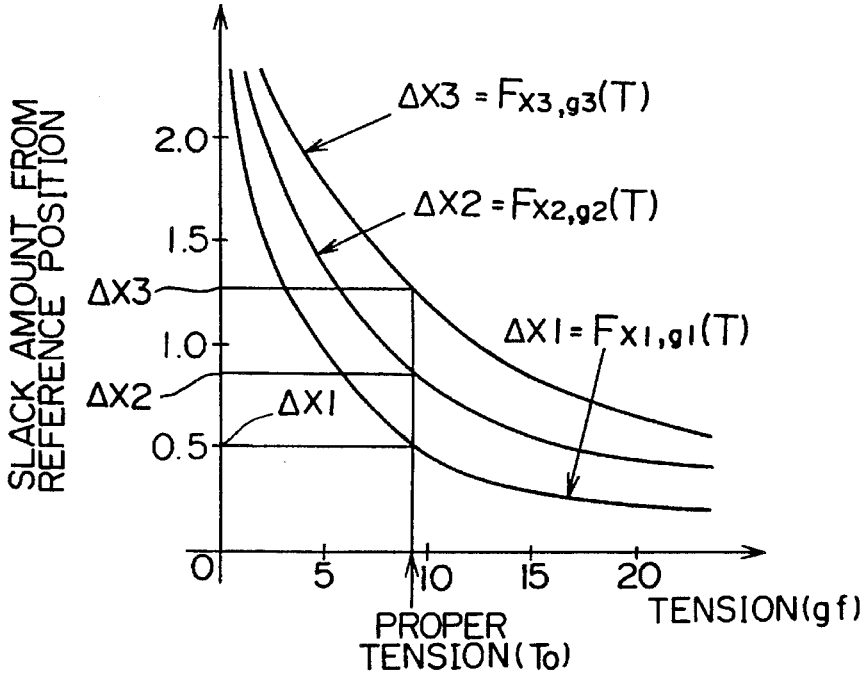
FIG. 7 is a graph showing the relationship of a proper slack amount of the silver portion between the front roller and the flyer top versus the sliver tension.

When deriving the latter data base, as shown in FIG. 6, the position of the sensor 25 is expressed by setting a straight line L connecting the front roller I and the flyer top 2*a* as the origin of the X-coordinate. Then, the position of the sensor 25 is changed and, for each position, a distance (slack amount) Δx from the straight line L to a thread position detected by the sensor 25 under a condition that the sliver R is stretched between the front roller 1 and the flyer 2*a* in a proper tension state, is measured depending on various roving conditions with different values of the roving amount. The slack amount Δx is expressed by a function of two variables, i.e., the position X of the sensor 25 and the roving weight (g), and is changed depending on the position X of the sensor 25 to provide a proper tension T, as shown in FIG. 7. The program memory 29 stores the data base in the form of a graph (curve) representing the relationship between the proper tension T and the proper slack amount Δx for various sets of the position X of the sensor 25 and the roving weight (g), as shown in FIG. 7. The slack amount Δx in the proper tension state may be determined by experiments or theoretically.

Figure 5:
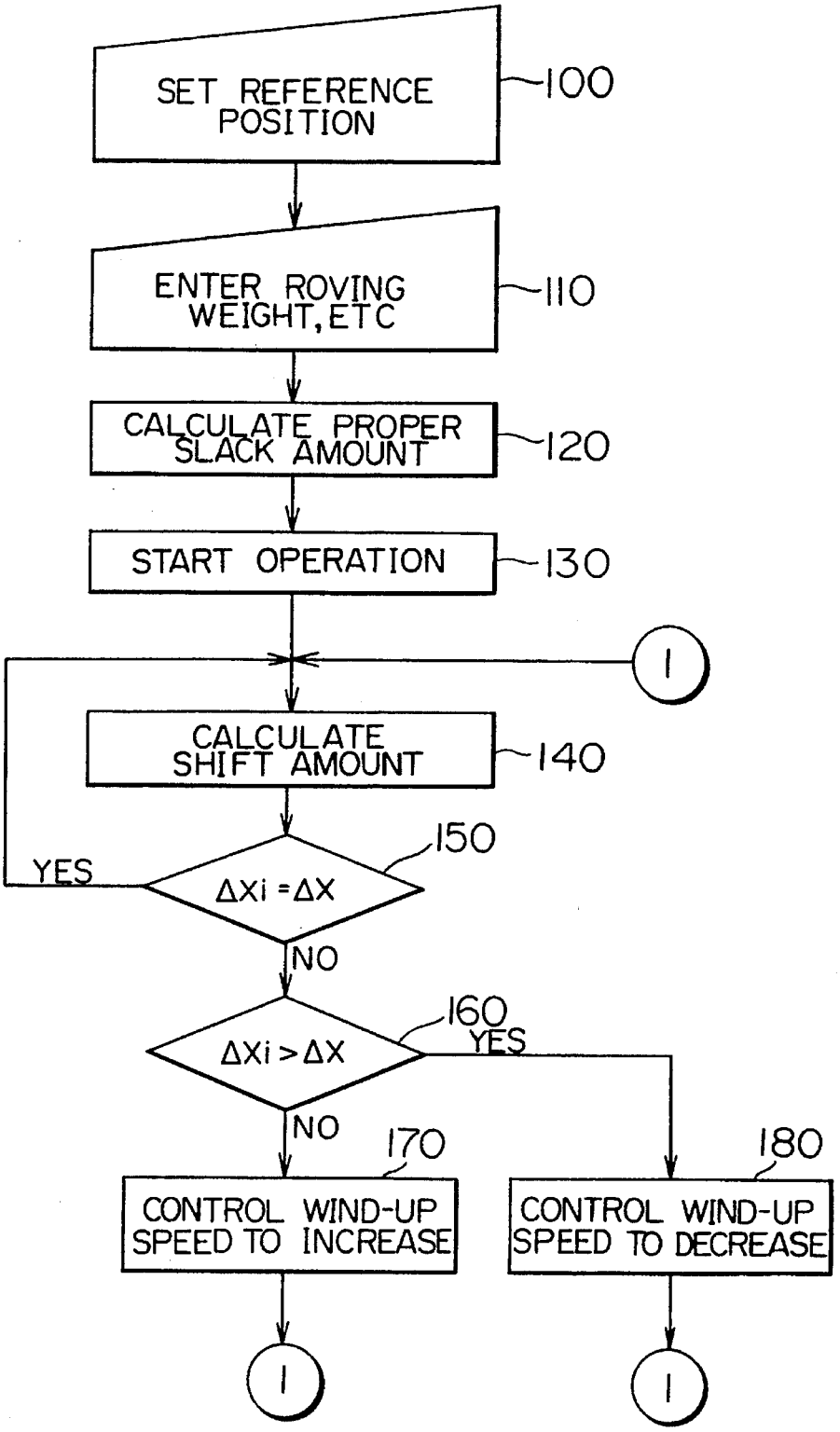
FIG. 5 is a flowchart showing procedures in the case of detecting a sliver position between a front roller and a flyer top and adjusting a sliver tension in accordance with the present invention.

Procedures for adjusting the tension based on the aforesaid latter data base will now be described with reference to FIGS. 1, 2 and 5. But, the parts overlapping with the above-explained embodiment and the procedures based on the aforesaid former data base will be omitted or simplified. First, prior to starting the machine, the thread R is stretched in a tight state between the front roller 1 and the flyer top 2*a*, as indicated by chain line in FIG. 6. Then, the setting switch S is turned on to store the position of the sensor 25 where the light is interrupted at that time in the working memory 31. This sliver position is a-reference position $X_0$ (step 100). Any other linear member may be stretched instead of the sliver R.

Next, in addition to the aforesaid roving conditions such as the roved thread weight and so on, the position of the sensor 25 is entered through the input unit 30 (step 110). When the roving conditions and the position of the sensor 25 are entered, the CPU 28 calculates the proper slack amount Δx under those roving conditions based on the aforesaid data base stored in the program memory 29 (step 120). For example, if the position of the sensor 25 is $X_1$ and the roved thread weight is $g_1$, the corresponding proper slack amount $\Delta x_1$ is determined from the graph of $\Delta x_1 = F_{x1,g1}(T)$. If the position of the sensor 25 is $X_2$ and the roved thread weight is $g_2$, the corresponding proper slack amount $\Delta x_2$ is determined from the graph of $\Delta x_2 = F_{x2,g2}(T)$. Furthermore, if the position of the sensor 25 is $X_3$ and the roved thread weight is $g_3$, the corresponding proper slack amount $\Delta x_3$ is determined from the graph of $\Delta x_3 = F_{x3,g3}(T)$. Then, the determined slack amount Δx is stored as a control target value in the working memory 31.

After that, operation of the machine is started (step 130), the sliver R is wound up in the form of a multilayered roll around the bobbin B while being twisted by the flyer 2, and further the bobbin rail 6 is driven to move up and down, as explained before. Likewise, the bobbin rotational speed is reduced by the predetermined amount for each increase in the number of wound thread layers, and the speed of up/down movement of the bobbin rail 6 is also reduced in synchronism with the wind-up speed.

The output signal of the sensor 25 is always applied to the controller 26 and, based on the output signal, the CPU 28 determines the actual position of the sliver R being roved and computes a shift amount $\Delta x_1$ from the reference position $x_0$ (step 140). Then, the CPU 28 compares the shift amount $\Delta x_1$ with the proper slack amount Δx and controls driving of the wind-up motor 11 via the inverter 10*b* so that the shift amount $\Delta x_1$ becomes equal to the proper slack amount Δx (steps 150, 160). Specifically, if the sliver R is in a state indicated by line B and positioned lower than the sliver R in the proper tension state indicated by line A, the wind-up motor 1 is controlled to drive at a higher speed <step 180). If the sliver R is in a position C higher than the position A of the sliver R in the proper tension state, the wind-up motor 1 is controlled to drive at a lower speed (step 170).

Thus, the reference position $x_0$ and the proper slack amount Δx for controlling the slack amount of the sliver R between the front roller 1 and the flyer top 2*a* so that the silver R is kept in the proper tension state in accordance with the roving conditions, are set to fixed values. As a result, set values vary between the sensors 25 provided on the same unit machine or different unit machines.

While the above embodiment has been explained as entering the position of the sensor 25 through the input unit 30 along with the roving conditions prior to operating the machine, the position of the sensor 25 may be stored in the working memory 31 beforehand since the sensor 25 is usually fixed at a predetermined position.

It should be understood that the data base used for setting the proper slack amount Δx may be a function including not only the roved thread weight but also the fiber kind as variables, or it may be in the form of a calculation formula for calculating the proper slack amount Δx from the roved thread weight, instead of using a graph.

Furthermore, the reference position for determining the shift amount $\Delta x_1$ of the sliver R leading from the front roller 1 to the flyer top 2*a* from the reference position in the detectable range of the sensor 25 in the proper tension state may be set to a position where a predetermined curve crosses the sensor 25, rather than the position where the straight line L connecting the front roller 1 and the flyer top 2*a* crosses the sensor 25. Specifically, the reference position may be set by stretching a thread or any other linear member, which has a predetermined length longer than the distance between the front roller 1 and the flyer top 2*a*, between the two components in a slacked state and adopting a sliver position detected by the sensor 25 at that time as the reference position.

The data of the proper slack amount may be input to the working memory 31 later rather than being input in the program memory 29 beforehand.

We claim:

1. A roving machine including a wind-up speed changing apparatus for reducing the rotational speed of a bobbin in response to an increase in the roving weight of a textile fiber wound thereon, said roving machine comprising:

a contactless position sensor for detecting the position of a sliver portion of said textile fiber located between a front roller and a flyer in said roving machine;

input means through which a plurality of roving condition data for said textile fiber are entered, said data for said textile fiber including at least its sliver weight, its fiber kind, the speed of rotation of said flyer, and the number of laps of said textile fiber over a presser in said roving machine;

storage means for storing a first database for determining the amount of decrease in bobbin rotational speed that corresponds to said increase in said roving weight of said textile fiber wound around said bobbin with said roving weight of said textile fiber as a variable, said storage means further storing a second database or a calculation formula for determining an adjustment to said amount of decrease in bobbin rotational speed, said adjustment corresponding to the amount of positional shift of said sliver portion from a reference position for said sliver portion of said textile fiber in a proper tension state within the detectable range of said position sensor with said roving weight of said textile fiber as a variable; and control means for reducing the rotational speed of said bobbin by determining the desired amount of the decrease in said bobbin rotational speed from data in said first database, determining an adjustment to said desired amount of said decrease in said bobbin rotational speed from data in said second database or calculation formula, adjusting said desired amount of decrease in said bobbin rotational speed by said determined adjustment, and outputting to said wind-up speed changing apparatus a control signal for reducing the rotational speed of said bobbin by the adjusted amount of said desired decrease.

2. The roving machine according to claim 1, further comprising memory means for storing roving condition data for, after a roving operation in a proper winding state, modifying the amount of said decrease in bobbin rotational speed that corresponds to said increase in said roving weight wound around said bobbin, for updating said first database.

3. The roving machine according to claim 2, wherein said control means comprises a central processing unit (CPU) in a computer, said storage means comprises a program memory within said computer, and said memory means comprises a working memory within said computer for storing said roving condition data entered through said input means.

4. The roving machine according to claim 3, wherein said first database is stored in said program memory, and said first database comprises at least the sliver weight (g), the fiber kind (m), the speed of rotation of said flyer (NF), the number of laps of said textile fiber over said presser (n) and a fiber type (t), and wherein said roving condition data for updating said first database are stored in said working memory.

5. The roving machine according to claim 1, wherein said control means comprises a central processing unit (CPU) in a computer, and said storage means comprises a program memory within said computer.

6. The roving machine according to claim 5, wherein said program memory stores, as said first database, the relation formula $\Delta = F(g)$, where $\Delta$ is the amount of decrease of bobbin rotational speed that corresponds to the roving weight of a textile fiber wound around said bobbin, and F is a function of the roving weight (g) for each of a plurality of classified sample groups of textile fibers, said relation formula having been derived by accumulating data on operating conditions in relation to the fiber kind (m), the speed of rotation of said flyer (NF), the number of laps over said presser (n) and a flyer type (t).

7. The roving machine according to claim 5, further comprising a setting switch connected to said control means, wherein said setting switch when turned on stores the position of said sliver portion detected by said position sensor at that time as the reference position in a working memory within said computer.

8. The roving machine according to claim 5, wherein said position sensor is fixed at a predetermined position, where said predetermined position is stored as the reference position in a working memory within said computer.

9. The roving machine according to claim 1, wherein said control means controls said reduction in said bobbin rotational speed using said amount of positional shift of said sliver portion from said reference position as indicated by said position sensor as a control target value during the operation of the roving machine so that said amount of positional shift of said sliver portion during said roving operation indicated by said position sensor becomes equal to said control target value.

10. The roving machine according to claim 1, wherein said reference position of said sliver portion is set to the position where a straight line connecting said front roller and said flyer crosses the detectable range of said position sensor.

11. The roving machine according to claim 1, wherein said reference position of said sliver portion is set to the position where a linear member stretched between said front roller and said flyer crosses the detectable range of said position sensor.

* * * * *

UNITED STATES PATENT AND TRADEMARK OFFICE

CERTIFICATE OF CORRECTION

PATENT NO. : 5,463,557

DATED : October 31, 1995

INVENTOR(S) : T. Nakano et al

It is certified that error appears in the above-indentified patent and that said Letters Patent is hereby corrected as shown below:

In the Abstract, line 5, after "over" insert --a--.

Column 2, line 67, after "determine" insert --the amount of decrease of--.

Column 6, line 11, "26" should read --2b--; line 30, line 30, after "flyer" delete "2"; line 31, after "over" delete "a" , insert --the--; after "presser" delete "26".

Column 8, line 14, delete "decrease" (first occurrence).

Column 9, line 7, after "roller" "I" should read —1—; line 36 delete hyphen "-" after "a".

Column 10, line 11, "1" should read --11--; "<step 180)." should read --(step 180).--; line 13 "1" should read --11--.

Signed and Sealed this

Twenty-sixth Day of March, 1996

*Attest:*

Bruce Lehman

BRUCE LEHMAN

*Attesting Officer*

*Commissioner of Patents and Trademarks*